US006633110B2

(12) United States Patent
McGuire et al.

(10) Patent No.: US 6,633,110 B2
(45) **Date of Patent: *Oct. 14, 2003**

(54) UNDERWATER LAMP

(75) Inventors: Kevin P. McGuire, Rochester, NY (US); Albert Honegger, Wolfhausen (CH); Felix Kessler, Binz (CH)

(73) Assignee: Tailored Lighting Inc., Rochester, NY (US)

( * ) Notice: Subject to any disclaimer, the term of this patent is extended or adjusted under 35 U.S.C. 154(b) by 125 days.

This patent is subject to a terminal disclaimer.

(21) Appl. No.: 09/876,607

(22) Filed: Jun. 7, 2001

(65) Prior Publication Data

US 2002/0125804 A1 Sep. 12, 2002

Related U.S. Application Data

(63) Continuation-in-part of application No. 09/592,192, filed on Jun. 12, 2000, and a continuation-in-part of application No. 09/193,360, filed on Nov. 17, 1998, now Pat. No. 6,075,872, and a continuation-in-part of application No. 08/923,563, filed on Sep. 4, 1997, now Pat. No. 5,977,694, and a continuation-in-part of application No. 08/606,694, filed on Feb. 27, 1996, now Pat. No. 5,666,017, and a continuation-in-part of application No. 08/291,168, filed on Aug. 16, 1994, now Pat. No. 5,569,983, and a continuation-in-part of application No. 08/216,495, filed on Mar. 22, 1994, now Pat. No. 5,418,419.

(51) Int. Cl.[7] ..... H01J 61/40
(52) U.S. Cl. ..... 313/113; 313/112
(58) Field of Search ..... 313/112, 113, 313/110, 116, 493, 489, 491; 348/786; 359/614; 362/267; 315/291, 294, 297, 307, 314

(56) References Cited

U.S. PATENT DOCUMENTS 4,344,118 A * 8/1982 Rundquist et al. ..... 362/267
4,667,278 A * 5/1987 Poyer ..... 362/267

* cited by examiner

*Primary Examiner*—Nimeshkumar D. Patel
*Assistant Examiner*—Jason Phinney
(74) *Attorney, Agent, or Firm*—Howard J. Greenwald

(57) ABSTRACT

A lamp assembly comprised of a waterproof casing, a lamp disposed within the casing, and a source of electrical current electrically connected to the lamp, from the source to the lamp. The lamp, when operated with a 12 volt power supply, consumes less than 40 watts The preferred lamp used in the assembly is described and claimed in U.S. Pat. No. 5,418,419.

31 Claims, 3 Drawing Sheets

UNDERWATER LAMP

CROSS-REFERENCE TO RELATED PATENT APPLICATIONS

This application is a continuation-in-part of U.S. patent application Ser. No. 09/592,192, filed on Jun. 12, 2000, of U.S. patent application Ser. No. 09/193,360, filed Nov. 17, 1998 (issued as U.S. Pat No. 6,075,872), of U.S. patent application Ser. No. 08/923,563, filed on Sep. 4, 1997 (issued as U.S. Pat. No. 5,977,694), of U.S. patent application Ser. No. 08/606,645, filed Feb. 27, 1996 (issued as U.S. Pat. No. 5,666,017), of U.S. patent application Ser. No. 08/291,168, filed on Aug. 16, 1994 (now U.S. Pat. No. 5,569,983), and of U.S. patent application Ser. No. 08/216,495, filed Mar. 22, 1994, (now U.S. Pat. No. 5,418,419). The entire disclosure of each of these United States patents is hereby incorporated by reference into this specification.

FIELD OF THE INVENTION

An underwater lamp assembly comprised of a lamp for producing a spectral light which is substantially identical in uniformity to the spectral light distribution of a desired daylight effect.

BACKGROUND OF THE INVENTION

Applicants have patented a series of daylight lamps, each of which may be used in the underwater lamp assembly of this invention.

Thus, e.g., U.S. Pat. No. 5,418,419, which was issued in 1995, is one of the daylight lamps which may be used in the lamp assembly of this invention.

Torch lamps for illuminating objects which are underwater are well known. Many of these torch lamp assemblies use standard halogen light bulbs. Although these halogen light bulbs produce a reasonably suitable spectral output when used above water, when used under water the illuminated objects have an unappealing, unnatural color.

To correct this problem, some of the prior art lamp assemblies have used dichroic color correcting filters disposed in front of the halogen lamp. This "solution" creates other problems, viz., the spectral and spatial distributions produced are uneven and substantially attenuated.

One may use metal halide lamps instead of halogen bulbs in an underwater lamp assembly. However, the metal halide lamps provide illuminated objects with an overly bluish appearance.

It is an object of this invention to produce a underwater lamp assembly which has a substantially even spectral power distribution at a relatively high color rendering index.

It is an object of this invention to provide an underwater lamp assembly which will illuminate underwater objects so that they appear with a natural color.

SUMMARY OF THE INVENTION

In accordance with this invention, there is comprised an underwater lamp assembly comprising a lamp disposed within a waterproof housing. The lamp used in this assembly preferably is the lamp claimed in U.S. Pat. No. 5,418,419, and it preferably consumes less than 40 watts of power.

BRIEF DESCRIPTION OF THE DRAWINGS

The invention will be described by reference to the following drawings, in which like numerals refer to like elements, and in which.

DESCRIPTION OF THE PREFERRED EMBODIMENT

In the lamp assembly of this invention, a specified lamp is preferably used. This lamp is the lamp which is claimed in U.S. Pat. No. 5,418,419, the entire disclosure of which is incorporated by reference into this specification. The device of this patent is an integral lamp for producing a spectral light distribution which is substantially identical in uniformity to the spectral light distribution of a desired daylight Throughout the entire visible light spectrum from about 400 to about 700 nanometers. The device contains a filament which, when excited by electrical energy, emits radiant energy throughout the entire visible spectrum with wavelengths (1) from about 400 to about 700 nanometers, at non-uniform levels of radiant energy across the visible spectrum. The device also contains a reflector body with a surface to intercept and reflect such visible spectrum radiant energy, said filament being positioned within said reflector so that at least 50 percent of said visible spectrum radiant energy is directed towards the reflector surface. The device also contains a filter coating on the surface of the reflector body, with a reflectance level to reflect radiation of every wavelength of the entire said visible spectrum radiant energy directed towards said reflector surface, and which when combined with the radiance of the visible spectrum radiant energy of the filament not directed towards said reflector surface produces a total usable visible light of relatively uniform radiance throughout every wavelength of the visible spectrum in substantial accordance with the formula: $R(1)=[D(1)-S(1)\times(1-X)]/[S(1)\times X]$, wherein R(1) is the reflectance of the reflector coating for said wavelength, D(1) is the radiance of said wavelength for the daylight color temperature, S(1) is e total radiance of said filament at said wavelength, and X is the percentage of visible spectrum radiant energy directed towards said reflector surface.

Figure 1:
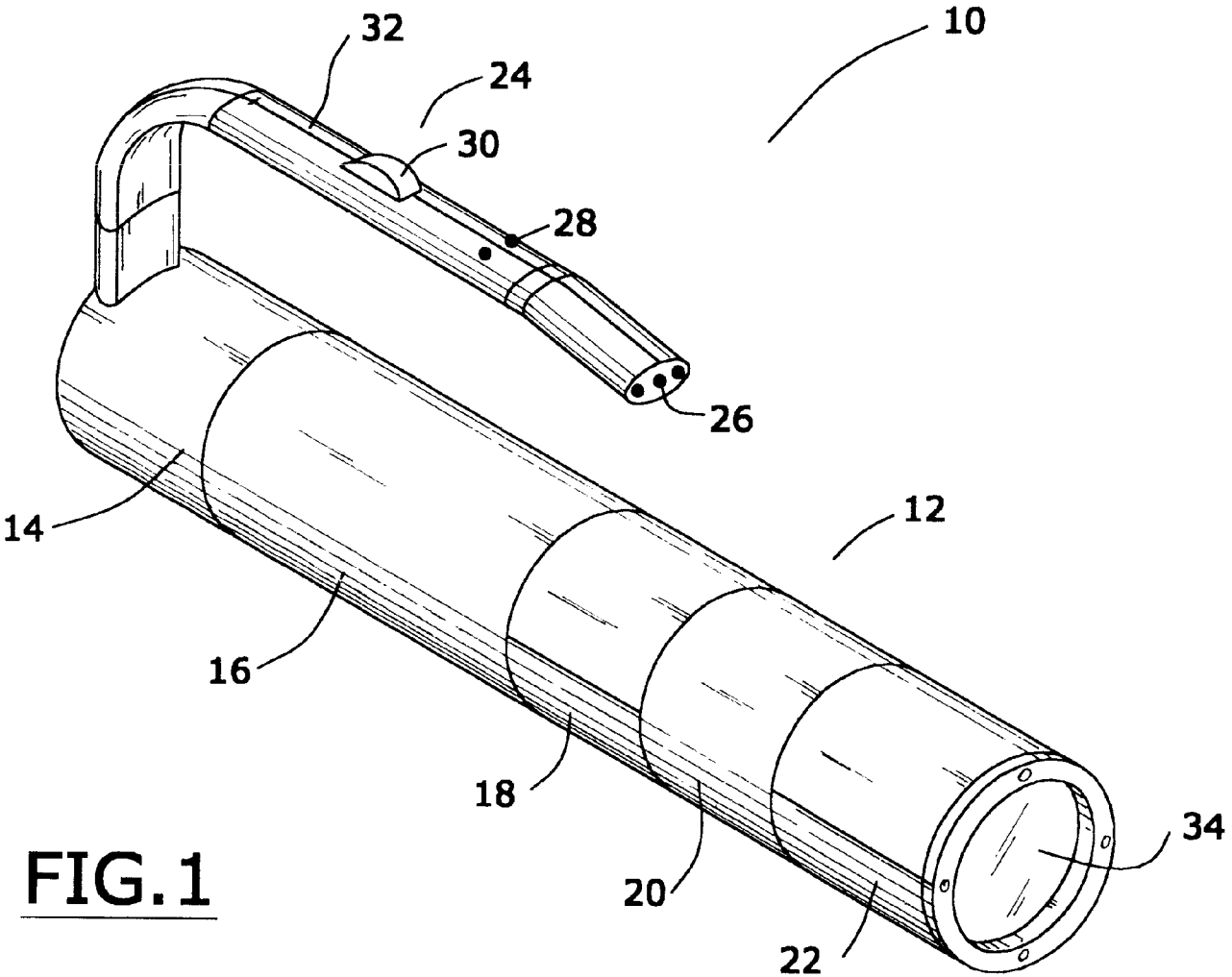
FIG. 1 a perspective view of one preferred lamp assembly of the invention.

FIG. 1 is a perspective view of one preferred underwater lamp assembly 10

The underwater lamp assembly 10 has a correlated color temperature, over wavelengths of from about 400 to about 700 nanometers, of from about 2,500 to about 6,500 degrees Kelvin. As is known to those skilled in the art, correlated color temperature is the temperature of a black body that has the same chromaticity as the test source. Reference may be had, e.g., to U.S. Pat. Nos. 6,229,916, 6,224,240, 6,208,070, 6,190,757, 6,160,579, 6,157,144, 6,157,126, 6,153,971, 6,137,217, 6,124,683, and the like. The entire disclosure of each of these United States patents is hereby incorporated by reference into this specification.

The underwater lamp assembly 10 of this invention is unique in that, at the color temperatures required for the human eye to see true colors, and when used underwater, it is characterized by a color rendering index of at least about 98. As is known to those skilled in the art, the color rendering index describes the changes in color of standard test objects when the illumination is changed from a standard to a test illuminant. Reference may be had, e.g., U.S. Pat. Nos. 6,234,648, 6,234,645, 6,224,240, 6,222,312, 6,218,323, 6,215,254, 6,200,918, 6,184,633, 6,166,495, 6,165,385, 6,1612,910, 6,157,126, 6,153,971, 6,147,453, 6,144,152, 6,137,230, 6,137,217, 6,124,683, and the like. The entire disclosure of each of these United States patents is hereby incorporated by reference into this specification.

At a color temperature of 4,100 degrees Kelvin, the lamp assembly, when used underwater, produces a color rendering index of at least 98. At color temperatures of 3,500 and 4,700 degrees Kelvin, the lamp assembly 10, when used underwater, also produces a color rendering index of at least about 98. In fact, over the range of color temperatures of from about 2,500 to about 6,500 degrees Kelvin, the lamp assembly 10 produces a color rendering index of at least 98. No other underwater lamp assembly which is commercially available produces such a uniformly high color rendering index over such a broad range of color temperatures.

Different bodies of water have different spectral properties, depending upon their composition and turbidity. The lamp assembly 10 allows one to choose the appropriate color temperature for any particular body of water without sacrificing the color rendering index performance.

The underwater lamp assembly 10 is substantially more durable than prior art underwater lamp assemblies. When operated with 12 volts direct current, it will produce a color temperature of at least 4,700 degrees Kelvin for at least 4,000 hours.

Referring again to FIG. 1, and in the preferred embodiment depicted therein, it will be seen that lamp assembly 10 is comprised of a casing 12, which encloses a lamp (not shown in FIG. 1) and a battery pack (not shown in FIG. 1). The casing 12 is substantially waterproof up to a pressure of about 20 atmospheres.

In one preferred embodiment depicted in FIG. 1, casing 12 is comprised of an electronic end cap 14 (which preferably is removable), a battery pack chamber 16, a battery pack/end cap assembly 18, a lamp head chamber 20, and a lamp head/end cap assembly 22.

Electronic end cap 14, in one embodiment, is made from anodized aluminum. Alternatively, electronic end cap 14 may be made from stainless steel, bronze, injection molded plastic, titanium, carbon fiber, and the like. Regardless of the material used for electronic end cap 14, it is preferred that it be relatively lightweight and have good physical properties.

Battery pack chamber 16 is also preferably made from aluminum, but in this case it is preferred that it have a different color than end cap 14. The materials used in battery pack chamber 16 may be identical to the materials used in electronic end cap 14, and the colors thereof may be the same or different. However, the heat dissipation properties of Battery pack chamber 16 preferably has a thermal conductivity of a least as high as the thermal conductivity of aluminum.

Referring again to FIG. 1, the components 18, 20, and 22 may be made from the same material or from similar materials to the material used in component 16.

Referring again to FIG. 1, it will be seen that a handle 24 is attached to casing 12, preferably to component 14 thereof. In one embodiment, not shown, handle 24 is attached to component 16. The handle 24 is preferably made from a anodized aluminum.

In the embodiment depicted in FIG. 1, handle 24 is hollow, containing a chamber (not shown) which may contain one or more electronic components. In one embodiment, a battery pack (not shown) may be disposed within handle 24. In another embodiment, circuitry adapted to activate light emitting diodes 26 may be disposed within handle 24 and may be activated by means of either switch 28 and/or by other means. In another embodiment, controls 30 are disposed on handle 24 and are adapted to control the intensity and properties of the light emitted from the lamp (not shown). As will be apparent, e.g., one may use a rheostat (not shown) to control the voltage delivered to the lamp (not shown).

In one embodiment, it is preferred to deliver from about 1 to 22 volts of direct current to the lamp and, preferably, at least about 14 volts to the lamp. It is preferred to deliver direct current to the lamp, but alternating current also may be used. When alternating current is used, it is preferred to deliver at least 14 volts r.m.s. to the lamp.

In one embodiment, depicted in FIG. 1, the portion 32 of handle 24 acts as a transceiver to receive and/or transmit signals to a global positioning satellite, a repeater, and/or other transceiving devices.

In one embodiment, handle 24 is removably attached to the casing 12. In one aspect of this embodiment, the handle 24 is comprised of a plug adapted to engage with a source of electrical current and to recharge any battery pack within such handle. In another aspect of this embodiment, when the handle 24 is removed from the casing 12, the circuitry within casing 12 is prevented from conducting electricity.

In one embodiment, a knife is disposed within either the chamber within the handle 24 and/or within the casing 12.

Referring again to FIG. 1, lamp head/cap assembly 22 is comprised of a transparent cover 34 which, in one embodiment, may be constructed from either glass or plastic. In one embodiment, the cover 34 is comprised of glass which, preferably, is lead-free. In one aspect of this embodiment, the glass cover 34 is a lens which may, e.g., a convex lens, a concave lens, or a fresnel optic.

In one embodiment, not shown, the glass cover lens 34 is a shuttered lens. One may use conventional shuttered lens assemblies in this embodiment. See, e.g., U.S. Pat. Nos. 5,926,511, 5,696,714, 5,640,640, 5,467,146, 5,294,993, and the like. The entire disclosure of each of these United States patents is hereby incorporated by reference into this specification.

In one embodiment, not shown, the glass cover lens assembly is comprised of a movable iris.

Figure 2:
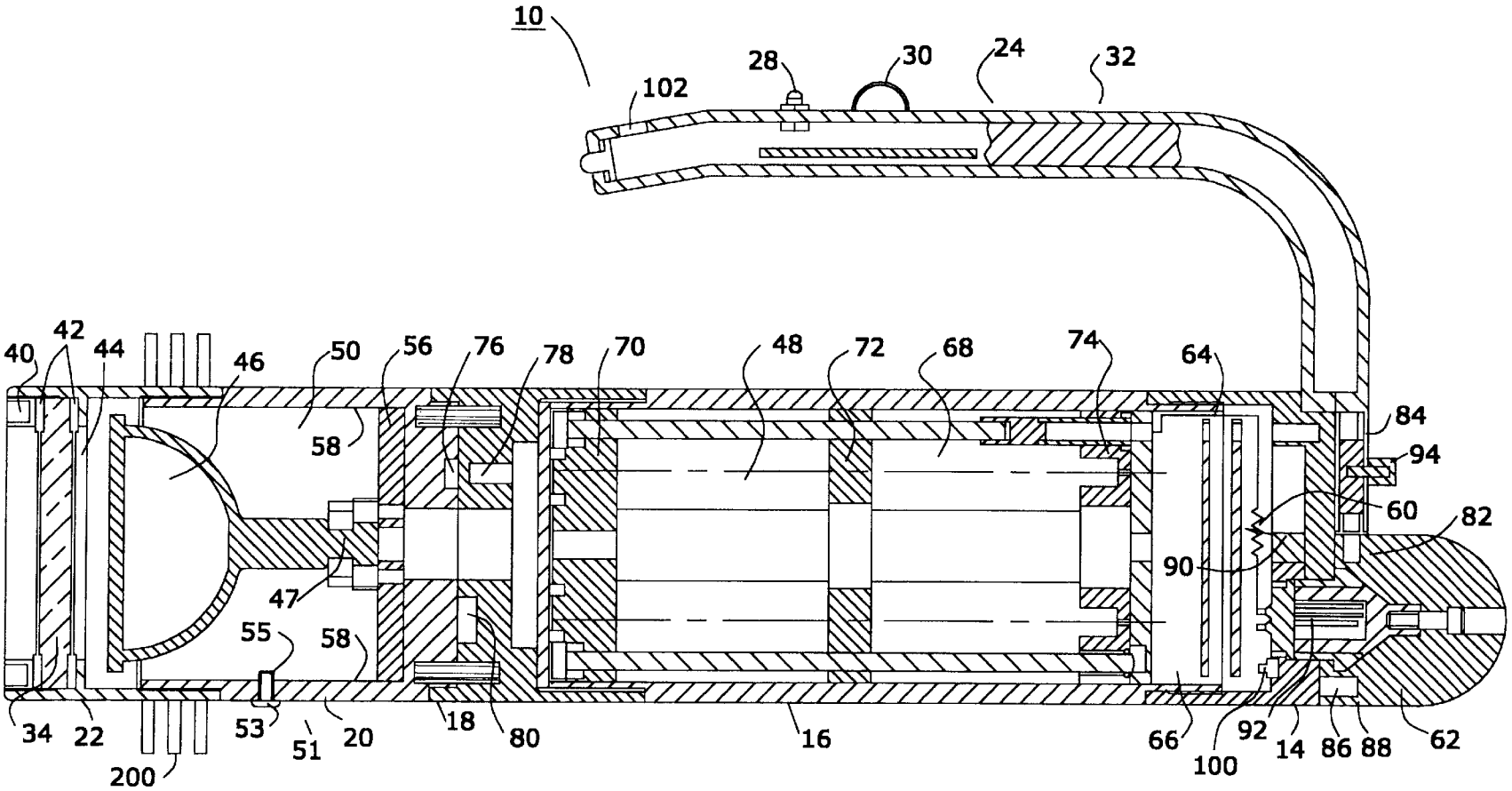
FIG. 2 is a sectional view of the lamp assembly of FIG. 1.

FIG. 2 is a sectional view of the assembly 10 depicted in FIG. 1. In the embodiment depicted, a glass holding ring 40 is disposed in front of, and removably secures, glass cover 34. In one embodiment, the glass holing ring 40 is made from aluminum, and it is removably connected to lamp head end cap assembly 22 by conventional means, such as threads.

Disposed behind glass holding ring 40 is an annular seal 42. The annular seal may be made of elastomeric material such as, e.g., silicone. Thus, e.g., one may use a conventional silicone gasket. In one embodiment, this annular seal 42 has a hardness rating of at least about 70 Shore.

Disposed behind the annular seal 42 is the glass cover 34. Disposed behind the glass cover 34 is another annular ring 44 which, in combination with the annular seal 42, firmly holds the glass cover 34 in place. The annular ring 44 may, e.g., be constructed from aluminum.

The lamp 46 preferably is substantially identical to the lamp described and claimed in U.S. Pat. No. 5,418,419, The entire disclosure of this United States patent is hereby incorporated by reference into this specification.

In one preferred process of the invention, the lamp 46 is driven with voltage from battery pack 48. In this preferred process, battery pack 48 provides at least about 14.4 volts. Applicants have discovered that, the use of such a relatively high voltage with lamp 46 produces unexpectedly efficient operation. Thus, by way of illustration and not limitation, when 65.3 watts of power is delivered to lamp 46 with a beam spread of 24 degrees at a voltage of 18 volts, the lamp produces a spectral output with a color temperature of 6138 degrees Kelvin, and a candlepower of 4,519 lumens per steradian. In this embodiment, about 69 lumens per steradian are produced per watt of power consumed. It is preferred that the lamp 46 with a beam spread of 24 degrees produce at least about 45 lumens per steradian per watt of power and, more preferably, at least about 55 lumens per steradian per watt of power.

The lamp 46 is relatively efficient, consuming less than 40 watts of power when driven with a 12 volt direct current power supply with a 24 degree beam spread. Despite such lower power, it will produce a color temperature of at least 3,500 degrees Kelvin, up to about 4,700 degrees Kelvin, with a candle power output of from about 2,430 to about 1,260 lumens per steradian.

Referring again to FIG. 2, and in the preferred embodiment depicted therein, only one lamp 46 is shown. In another embodiment, two or more lamps 46 are used. In one aspect of this embodiment, a multiplicity of lamps 46 are rotatably mounted in front of glass cover 34 and can be sequentially disposed in front of said glass cover to change the spectral output of device 10.

The lamp 46 is disposed within a chamber 50, within socket 47. In the embodiment depicted in FIG. 2, socket 47 is disposed in front of heat shield 56. In another embodiment, not shown, socket 47 is disposed behind heat shield 56.

In one preferred embodiment, the chamber 50 is filled with one or more inert fluids and/or gases to prevent arcing. As is known to those skilled in the art, arcing is a phenomenon caused by the transfer of electrons from a negative source of electrons to a positive of electrons. Arcing is eliminated in an inert atmosphere.

Thus, the chamber 50 may be evacuated so that a vacuum exists. Thus, e.g., the chamber 50 may consist of an inert gas, such as argon, nitrogen, helium krypton, etc. This is a preferred environment for the bulb 46 to be in.

In the embodiment depicted in FIG. 2, the inert gas may be introduced via line 51 through valve 53 through port 55. It is preferred, prior to the time such gas in introduced, to first evacuate chamber 50 so that all of the air is removed therefrom.

Disposed behind lamp 46 is a heat conductive shield 56 which preferably is made from a heat absorbing material 56. The heat absorbing material will preferably have a thermal conductivity (as measured by A.S.T.M. Test Method C-177), in $10^{-4}$ calories-centimeter/second-centimeter$^2$-degree C., of at least 8. Thus, e.g., one may use aluminum as the heat conducting material for the shield 56. One may use one or more other heat shields at one or more other positions within casing 12.

Referring again to FIG. 2, the heat conducting shield is contiguous with the inner surface 58 of lamp head chamber 20. In another embodiment, not shown, the shield 56, and/or another comparable shield, is contiguous with the inner surface of another portion of casing 12.

The battery pack 48 is preferably connected to a potentiometer which is operatively connected to a control such as, e.g., control 30 and/or control 62. By varying the resistance of potentiometer 60, one can vary the amount of voltage delivered to the lamp 46.

In operation, current from battery pack 48 travels through line 64 through potentiometer 60, through line 66, and then through lamp 46.

The battery pack 48 is comprised of a multiplicity of batteries 68, preferably a multiplicity of 1.2 volt batteries 68. The batteries 68 are preferably nickel metal hydride batteries, or lithium batteries. Thus, e.g., one may use batteries sold as "FORTU BAT" by the Batterien GmbH company of Wosshbacher Strasse 37, D-76327 Pfintzal/German. Thus, e.g., one may use the batteries sold by the Leclanche S. A. company of 48 avenue de Grandson, CH-1491 Yverdon-les Bains, Switzerland. One may, e.g., also use batteries sold by the Varta Company of Switzerland, by Sanyo, by Panasonic, etc.

In one embodiment, not shown, when the assembly 20 is disconnected from assembly 18, a connector is provided on assembly 20 to allow operation from a remote source of direct current, such as another battery.

The batteries are disposed between rings 70, 72, and 74. The rings 70, 72, and 74 preferably are constructed of heat-resistant material such as, e.g., polyphenhylene oxide. One suitable polyphenylene oxide material is sold as "NORYL." Other suitable heat-resistant materials also may be used.

In one embodiment, the rings 70, 72, and 74 are comprised of polyphenylene oxide filled with from about 20 to about 40 weight percent of filler, such as glass.

Referring again to FIG. 2, and in the embodiment depicted, a first magnet 76 is contiguous with a safety switch contact 78 and, when so contiguous, allows current to flow to lamp 46. The safety switch contact 78 may be brought out of contact with magnet 76 by manually separating the two, pulling them apart. Thus, e.g., one may remove the light 46 from the assembly 10 (thereby breaking contact with the battery pack) and substitute a new light 46.

In the embodiment depicted in FIG. 2, a bank of light emitting diodes are preferably disposed within cavity 80 and are activated when the switch contact 78 is activated.

Referring again to FIG. 2, a rotatable switch 82, also known as a turnswitch key, is mounted on the back surface 84 of electronic end cap 14 and can be moved through a multiplicity of positions. In one embodiment, the switch 82 moves from between 4 to about 20 different positions.

The switch is connected to means for varying the amount of voltage delivered to the lamp 46, as the switch 82 is rotated. In one embodiment, the rotation of switch 82 varies the resistance of potentiometer 60.

In the embodiment depicted in FIG. 2, a magnet 86 is disposed near the inner surface 88 of switch 82. As the magnet 86 is rotated, it will become magnetically engaged and disengaged with a sensor 90. When the magnet 86 is engaged with the sensor 90, the sensor circuit (not shown) will cause current to flow to lamp 46. When the magnet is disengaged with the sensor 90, the circuit will be open. A multiplicity of sensors 90 may be used to cause different amounts of current and/or voltage t be supplied to the lamp 46, as the switch 82 is rotated.

In the embodiment depicted in FIG. 2, when magnetic switch 82 is removed from the assembly, a receptacle 92 is adapted to receive a male plug (not shown) connected to a cable and a source of electrical energy. The removal of the switch 82 disengages the battery pack 48 from the lamp 46 and allows the battery pack 48 to be recharged from an external source of electricity (not shown). One may use a conventional receptacle such as, e.g., Lemo connectors. See, e.g., U.S. Pat. Nos. 5,903,117, 5,414,025, 5,201,325, 5,020,933, and the like. The entire disclosure of each of these United States patents is hereby incorporated by reference into this specification.

Referring again to FIG. 2, pin 94 provides a safety lock feature for locking switch 82 in place.

During the operation of the torch lamp 10, the internal atmosphere within the casing 12 increases its temperature and pressure. In order to control such temperature and pressure build up, there is provided a means for venting gas to the atmosphere.

One may use any conventional means for venting gas within casing 12 to the atmosphere. In one embodiment, a pressure relief valve 100 is used. This pressure relief valve is preferably activated at a pressure in excess of the pressure of the atmosphere within which the device 10 is disposed. As will be apparent, the ambient pressure when the device is disposed within deep water may be substantially different from the ambient pressure when the device is in air at sea level.

A display 102 is disposed on the surface of casing 12, and/or on the handle 24, and/or on the back surface of the device 14. The display is preferably adapted to show when the lamp 46 is charging, when the lamp 46 is discharging, the state of charge of battery pack 48, the amount of voltage being delivered to battery pack 48, the signal strength of any signals being received by the device, 10, the signal strength of any signals being transmitted by device 10, and the like.

In one embodiment, when the battery pack drops below a certain voltage level, the lamp 46 is caused to flash and immediately drop down to the lowest voltage setting which will enable its operation.

In one embodiment, when switch 82 is in one specified position, the device 10 will transmit an "SOS" signal in Morse Code as well as the location of the device 10. In one aspect of this embodiment, the rate of transmission of the Morse Code signal(s) will vary with time, becoming slower over time to conserve battery life.

Figure 3:
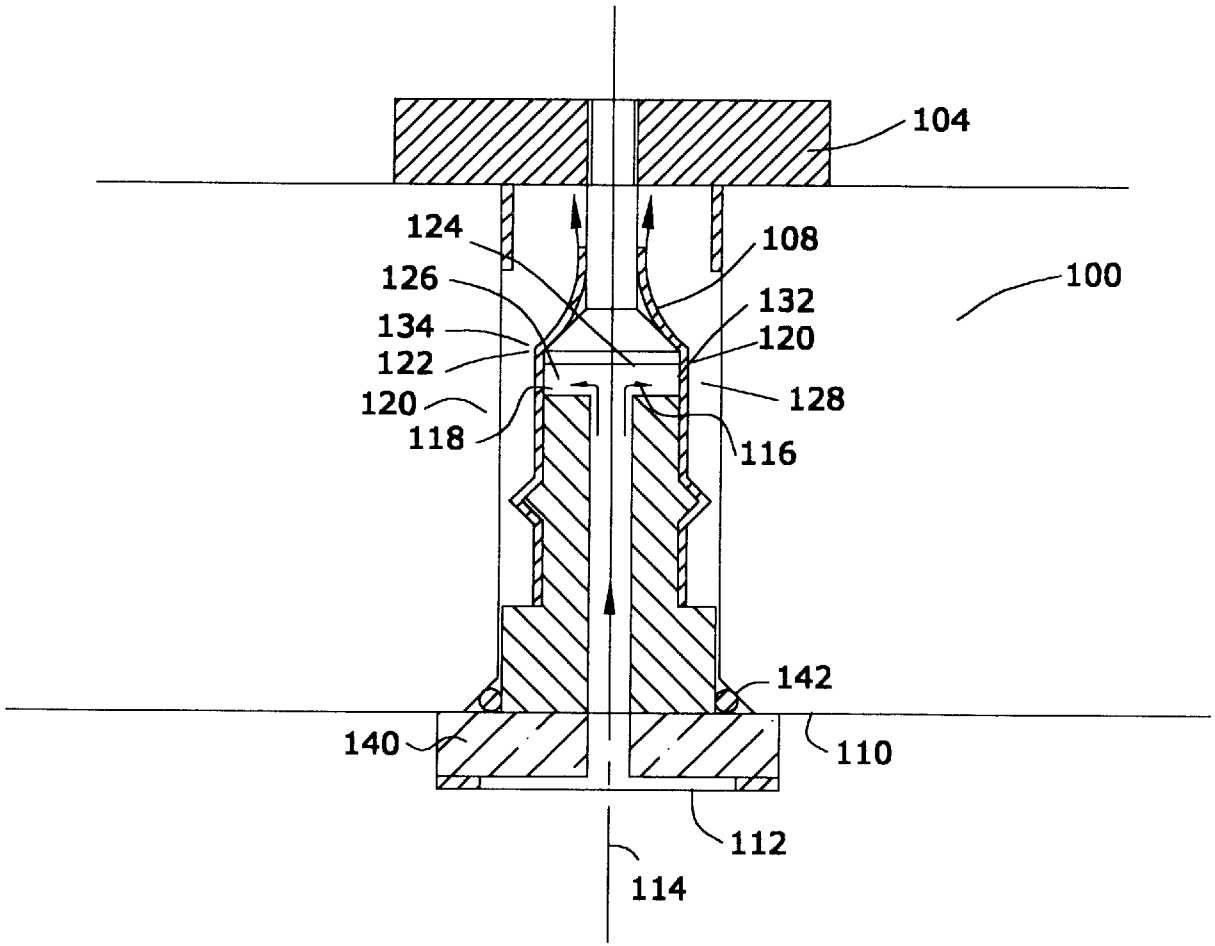
FIG. 3 is a sectional view of a valve device used in the lamp assembly of FIG. 1.

FIG. 3 is a sectional view of on preferred pressure relief valve 100, which is comprised of a nut 104 threadably engaged with threaded shaft 106. Gas from within the casing 12 contacts membrane 112. Membrane 112 is adapted to pass only gas but not fluid. The gas which passes through membrane 112 in the direction of arrow 114 and thence in the direction of arrows 116 and 118.

When the pressure outside of the valve 100, at points 120 and 122, is greater than the pressure within valve 100, at points 124 and 126, the difference in pressure will cause flexible membrane 108 to constrict inwardly in the direction of arrows 128 and 130, until inner surface 132 and inner surface 134 are contiguous with each other, thereby cutting off the flow of gas. Only when the pressure within the valve 100 exceeds the ambient pressure outside of the valve 100 will the gas be allowed to escape to atmosphere. Thus, as will be apparent, this passive valve automatically corrects for the effects of pressure within the device 10.

One may use many of the flexible membranes which are commercially available. Thus, e.g., one may use a flexible membrane sold as Selbstklenendes Druckausgleichselement (DAE) by the Schreiner GmbH & Co. KG of Bruckmanning 22, 85764 Oberscheisshim, Germany.

In the embodiment depicted, adhesive 110 adhesively joins membrane 112 to the casing 140 of valve 100. O-rings 142 are adapted to keep water out of the system.

In one embodiment, the lamp 46 is a Xenon lamp As is known to those skilled in the art, Xenon lamps contain Xenon, a rare gas often used in small high-pressure arc lamps. Reference may be had, e.g., to U.S. Pat. Nos. 6,239,895, 6,239,275, 6,236,785, 6,236,021, 6,232,402, and the like. The entire disclosure of each of these United States patents is hereby incorporated by reference into this specification.

In one embodiment, the lamp 46 consumes in excess of 50 watts when powered by 12 volts for a 24 degree beam spread. In this embodiment, a spectral output is produced with a color temperature of a least 3,500 degrees Kelvin and from about 3,500 to about 4,700 degrees Kelvin. The candlepower produced is from about 3,186 to about 1,774 lumens per steradian.

In one embodiment, the lamp 46 consumes in excess of 65 watts when powered by at least 14.0 volts for a 24 degree beam spread.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

Thus, e.g., and referring to FIG. 2, the device 10 may contain a multiplicity of heat dissipating fins 200 may be disposed on part or all or more than one part but less than the entire outside surface of casing 12. With this embodiment, the device 10 may be advantageously used outside of water.

What is claimed is:

1. A lamp assembly comprised of a waterproof casing, a lamp disposed within said casing, and a source of electrical current electrically connected to said lamp, from said source to said lamp, wherein:

(a) said lamp, when operate with a 12 volt power supply, consumes less than 40 watts, (b) said lamp is an integral lamp for producing a spectral light distribution which is substantially identical in uniformity to the spectral light distribution of a desired daylight throughout the entire visible light spectrum from about 400 to about 700 nanometers, (c) said lamp comprises a filament which, when excited by electrical energy, emits radiant energy throughout the entire visible spectrum with wavelengths (1) from about 400 to about 700 nanometers, at non-uniform levels of radiant energy across the visible spectrum, (d) said lamp is comprised a reflector body with a surface to intercept and reflect such visible spectrum radiant energy, said filament being positioned within said reflector so that at least 50 percent of sa d visible spectrum radiant energy is directed towards said reflector surface, and (e) said lamp is comprised of a filter coating on the surface of the reflector body, with a reflectance level to reflect radiation of every wavelength of the entire said visible spectrum radiant energy directed towards said reflector surface, and which when combined with the radiance of the visible spectrum radiant energy of the filament not directed towards said reflector surface produces a total usable visible light of relatively uniform radiance throughout every wavelength of the visible spectrum in substantial accordance with the formula: $R(1)=[D(1)-[S(1)\times(1-X)]]/[S(1)\times X]$ wherein R(1) is the reflectance of the reflector coating for said wavelength, D(1) is the radiance of said wavelength for the daylight color temperature, S(1) is the total radiance of a d filament at said wavelength, and X is the percentage of visible spectrum radiant energy directed towards said reflector surface.

2. The lamp assembly as recited in claim 1, wherein said lamp assembly further compromises means for varying the voltage fed from said source of electrical current to said lamp.

3. The lamp assembly as recited in claim 2, wherein said means for varying the voltage is comprised of means for varying said voltage from a voltage of from about 1 volt to about 22 volts.

4. The lamp assembly as recited in claim 3, wherein said means for varying the voltage comprises a potentiometer.

5. The lamp assembly as recited in claim 3, wherein said means for varying the voltage comprises a magnetic switch.

6. The lamp assembly as recited in claim 1, wherein said lamp assembly further comprises me for venting gas contained within said lamp assembly to outside of said lamp assembly.

7. The lamp assembly as cited in claim 6, wherein said means for gas is comprised of a pressure relief valve.

8. The lamp assembly as recited in claim 1, wherein said lamp assembly further comprises means for conducting heat from said lamp to said casing.

9. The lamp assembly as recited in claim 8, wherein said means for conducting heat from said lamp to said casing is comprised of a heat shield disposed within said casing.

10. The lamp assembly recited in claim 1, wherein said lamp is disposed within a sealed chamber within said casing.

11. The lamp assembly recited in claim 10, wherein said sealed chamber is comprised of an inert atmosphere.

12. The lamp assembly recited in claim 11, wherein said inert atmosphere is helium.

13. The lamp assembly recited in claim 1, wherein a multiplicity of heat fins are disposed on the outer surface of said casing.

14. The lamp assembly as recited in claim 1, wherein said lamp further comprises a handle.

15. The lamp assembly recited in claim 14, wherein said handle is comprised of a chamber disposed within said handle.

16. The lamp assembly a recited in claim 15, wherein a position finding device is disposed within said handle.

17. The lamp assembly a recited in claim 15, wherein means for activating light emitting diodes are disposed within said handle.

18. The lamp assembly as recited in claim 1, wherein said lamp assembly further comprises a switch removably connected to said casing.

19. The lamp assembly as recited in claim 16, wherein said switch is a magnetic switch.

20. The lamp assembly recited in claim 1, wherein said lamp is disposed within a lamphead assembly.

21. The lamp assembly as recited in claim 20, wherein said lamphead assembly is removably attached to battery pack enclosure.

22. The lamp assembly as recited in claim 19, wherein said lamphead assembly is comprised of a first cable adapted to be connected to an external power source.

23. The lamp assembly recited in claim 19, wherein a multiplicity of light emitting diodes is disposed within said casing.

24. A lamp assembly comprised of a waterproof casing, a lamp disposed within said casing, and a source of electrical current electrically connected to said lamp, from said source to said lamp, wherein:

(a) said source of electrical current provides more than 14 volts to said lamp, (b) said lamp consumes more than 65 watts of power, (c) said lamp is an integral lamp for producing a spectral light distribution which is substantially identical in uniformity to the spectral light distribution of a desired daylight throughout the entire visible light spectrum from about 400 to about 700 nanometers, (d) said lamp comprises a filament which, when excited by electrical energy, emits radiant energy throughout the entire visible spectrum with wavelengths (1) from about 400 to about 700 nanometers, at non-uniform levels of radiant energy across the visible spectrum, (e) said lamp is comprised of a reflector body with a surface to intercept and reflect such visible spectrum radiant energy, said filament being positioned within said reflector so that at least 50 percent of said visible spectrum radiant energy is directed towards said reflector surface, and (f) said lamp is comprised of a filter coating on the surface of the reflector body, with a reflectance level to reflect radiation of every wavelength of the entire said visible spectrum radiant energy directed towards said reflector surface, and which when combined with the radiance of the visible spectrum radiant energy of the filament not directed towards said reflector surface produces a total usable visible light of relatively uniform radiance throughout every wavelength of the visible spectrum in substantial accordance with the formula: $R(1)=[D(1)-[S(1)\times(1-X)]]/[S(1)\times X]$, where R(1) is the reflectance of the reflector coating for said wavelength, D(1) is the radiance of said wavelength for the daylight color temperature, S(1) is the total radiance of said filament at said wavelength, and X is the percentage of visible spectrum radiant energy directed towards said reflector surface.

25. The lamp assembly as recited in claim 24, wherein said lamp assembly further comprises means for varying the voltage fed from said source of electrical current to said lamp.

26. The lamp assembly recited in claim 25, wherein said means for varying the voltage is comprised of means for varying said voltage from a voltage of from about 14 volts to a voltage of about 22 volts.

27. The lamp assembly as recited in claim 26, wherein said means for varying the voltage further comprises a magnetic switch.

28. The lamp assembly as recited in claim 25, wherein said lamp assembly further comprises means for venting gas contained within said lamp assembly to outside of said lamp assembly.

29. The lamp assembly as recited in claim 28, wherein said means for venting gas further comprises a pressure relief valve.

30. The lamp assembly recited in claim 25, wherein said lamp assembly is comprised of means for conducting heat from said, lamp to said casing.

31. The lamp assembly as recited in claim 30, wherein said means for conducting heat from said lamp to said casing is comprised of a heat shield disposed within said casing.

* * * * *